United States Patent [19]

Calleance

[11] 4,080,676

[45] Mar. 28, 1978

[54] WATER MATTRESS CONSTRUCTION

[75] Inventor: David P. Calleance, San Francisco, Calif.

[73] Assignee: Sandra L. Calleance, San Francisco, Calif. ; a part interest

[21] Appl. No.: 761,499

[22] Filed: Jan. 21, 1977

[51] Int. Cl.[2] ..... A47C 27/08

[52] U.S. Cl. ..... 5/371; 5/350; 5/370

[58] Field of Search ..... 5/365, 370, 371, 349, 5/350

[56] References Cited

U.S. PATENT DOCUMENTS

| | | | |
|---|---|---|---|
| 3,918,110 | 11/1975 | Cantillo et al. | 5/371 |
| 4,006,501 | 2/1977 | Phillips | 5/371 |

*Primary Examiner*—Casmir A. Nunberg

*Attorney, Agent, or Firm*—Harris Zimmerman

[57] ABSTRACT

A water mattress construction which includes an interior perametrical air chamber comprises three similar web portions of polyvinyl material or the like. The mattress is formed by first securing an air valve through the top sheet near the edge thereof. A first seam, which is spaced inwardly from the perimeter of the sheets, is then made to join the upper and medial web portions. A water valve is then secured through the upper and medial web portions, and is secured within the confines of the first seam. A second, perametrical seam is then made to join the outer edges of all three web portions. The chamber defined by the upper and medial web portions and the two seams is filled with air, and the chamber defined by the medial and lower web portions is filled with water.

2 Claims, 10 Drawing Figures

WATER MATTRESS CONSTRUCTION

BACKGROUND OF THE INVENTION

Although the water mattress has been known for more than 40 years, it has only recently gained wide acclaim and popularity. The major attractions of the water mattress are its bouyant comfort, its therapeutic value for those suffering from back ailments, and the pleasure of sleeping on a heated mattress.

Detractors of the water mattress have criticized it for its other well-known characteristics. For example, wave motion within the water that fills the mattress is only slightly damped, and may continue for some period of time. Although many people find this wave action enjoyable, others find that it is not conductive to sound sleep. Furthermore, this wave action may have a resonant frequency which is a function of the size of the mattress, the volume of the water filling the mattress, and the load supported by the mattress. Many individuals have found this resonant frequency phenomena not conducive to sleep or other bedroom pursuits.

Furthermore, although the water mattress may be unexcelled in providing uniform support to the human body, this support is only available in the medial portions of the water mattress. Any weight which is applied to the outer portions of the water mattress will merely displace water towards the center of the mattress, causing the outer portion to sag or collapse. Thus, a sleeping individual may easily roll into the frame which supports the edge of the mattress. Likewise, it is difficult, if not impossible, to sit on the edge of a water mattress, even when it is supported within a rigid framework.

The prior art is replete with methods and devices for overcoming the disadvantages of the water mattress. For example, partitions have been placed within the water mattress to dampen the wave action of the water. Also, water mattresses have been filled with gel preparations which increase the viscosity of the water, and reduce the wave propagation therein.

One effective modification of the standard water mattress has been the introduction of air chambers within the water mattress. These air chambers are used to increase the support which is provided by the mattress at the extremities thereof, and also to reduce or eliminate wave propagation and persistance within the mattress. Unfortunately, an air chamber augmented water mattress is much more difficult to manufacture, due to the many extra parts which must be assembled, and the great increase in the number of welds which must be made within the mattress. The construction techniques thus become arduous and time consuming, and the cost to the consumer is quite high.

Patents which exemplify the state of the prior art include: U.S. Pat. Nos. 3,766,579, 3,778,852, 3,864,768.

SUMMARY OF THE INVENTION

The present invention generally comprises a water mattress construction and method of construction therefor, which provides a simplified, air chamber augmented water mattress. It includes three substantially identical web sheets of polyvinyl material or the like which are assembled according to the method of the present invention. The air chamber is disposed about the upper perametrical portion of the water mattress, where it provides support for an individual sitting on the edge of the bed as well as reducing wave phenomena known in the prior art.

The method of the present invention commences with the placement of the three web sheets in a vertically stacked disposition. An air valve is installed in the upper web sheet, in a location adjacent to the edge thereof. A continuous, endless inner seam, which is spaced inwardly from the edges of the web sheets, is then effected to join the upper web sheet to the medial web sheet. A water valve is then installed through the upper and medial web sheets, and is disposed within the confines of the inner seam. Next, an edge weld is effected to join all of the web sheets in a continuous sealed fashion.

In the present invention, the water chamber is defined by the medial and lower web sheets, extending the width and length of the mattress. Access to the water chamber is available through the water valve, which extends through the upper and medial web sheets. The air chamber is defined by the inner seam and the outer seam, and the upper and medial web sheets. This air chamber extends about the periphery of the water mattress, and is generally disposed above a lateral midline thereof. Access to the air chamber is available through the air valve which extends through the upper web sheet.

A BRIEF SUMMARY OF THE DRAWINGS

DESCRIPTION OF THE PREFERRED EMBODIMENT

The present invention generally comprises a unique water mattress construction, and a method for fabricating the water mattress. The method of the present invention comprises a series of steps which are shown consecutively in FIGS. 1 through 9 in the accompanying drawings.

Figure 1:
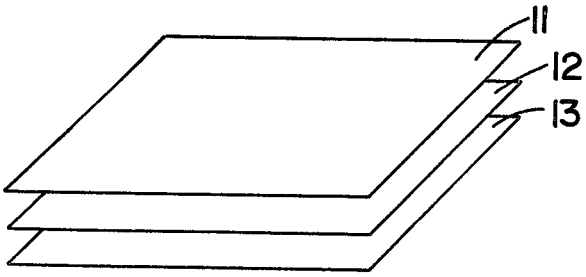
FIG. 1 is a perspective view of the three web sheets of the present invention during the initial stage of construction.
Figure 2:
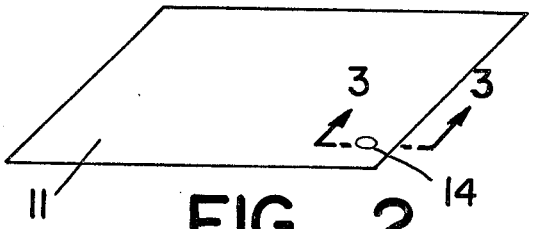
FIG. 2 is a perspective view of the top web sheet, shown with the air valve installed.
Figure 3:
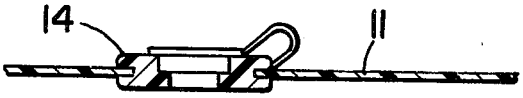
FIG. 3 is a cross-sectional detailed view taken along line 3—3 of FIG. 2.

As shown in FIG. 1, the method of the present invention commences with the provision of three web portions 11, 12, and 13, which are formed of polyvinyl material or the like. These web portions are identical in size and configuration, and are arranged in vertically stacked relationship. As shown in FIGS. 2 and 3, an air valve 14 is installed through the web portion 11, adjacent to one edge thereof. The air valve 14 may comprise any form of stopper valve, or any similar valve construction known in the prior art. In the preferred embodiment, the valve is installed at a distance of 2 to 13 inches from the outer edge of the web portion 11.

Figure 4:
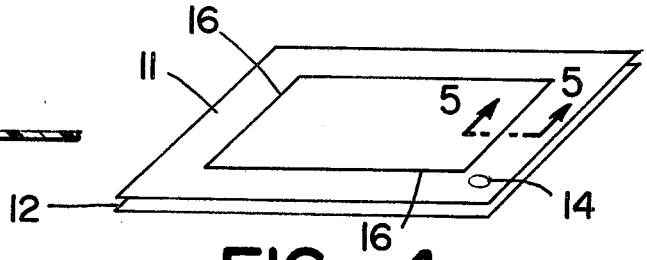
FIG. 4 is a perspective view showing the inner seam joining the top and medial web sheets of the present invention.
Figure 5:
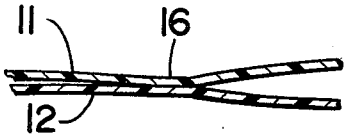
FIG. 5 is a cross-sectional detailed view taken along line 5—5 of FIG. 4.
Figure 6:
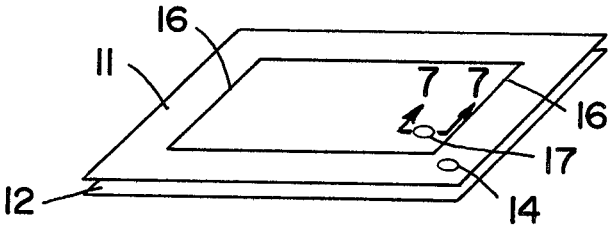
FIG. 6 is a perspective view of the top and medial web sheets, showing the water valve extending therethrough.
Figure 7:
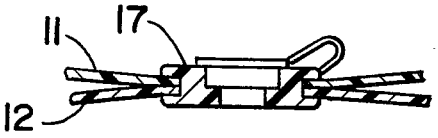
FIG. 7 is a cross-sectional detailed view taken line 7—7 of FIG. 6.

The next step of the method of the present invention is shown in FIGS. 4 and 5. In this step, a continuous endless weld 16 is made to join the web portions 11 and 12 together. The weld 16 is a butt weld, as is clearly shown in FIG. 5. In the preferred embodiment, the weld 16 is disposed 6 to 15 inches from the outer edges of the web portions. Next, a water valve 17 is installed through both web portions 11 and 12, within the confines of seam 16. The water valve shown in FIG. 7 is a conventional stopper valve, although any suitable valve known in the prior art may be employed.

Figure 8:
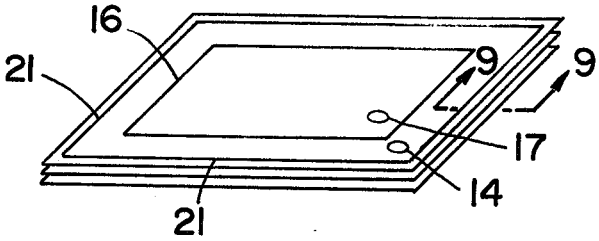
FIG. 8 is a perspective view of the three web sheets of the present invention, showing the edge weld joining all of the web sheets together.
Figure 9:
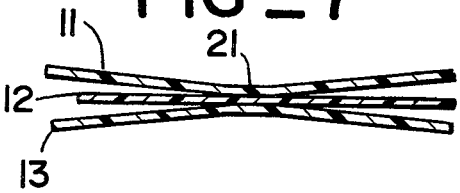
FIG. 9 is a cross-sectional detailed view taken along line 9—9 of FIG. 8.

The final step in the method of the present invention is the provision of an edge weld 21 which joins the web portions 11, 12, and 13 together. The weld 21 is continuous and endless, so that the web portions are joined in a permanent, sealed fashion. The weld 21 shown in FIGS. 8 and 9 is depicted as a butt weld. However, it may be appreciated by those skilled in the art that a lap weld could also be used to join the web portions together along the outer edge of the water mattress.

Figure 10:
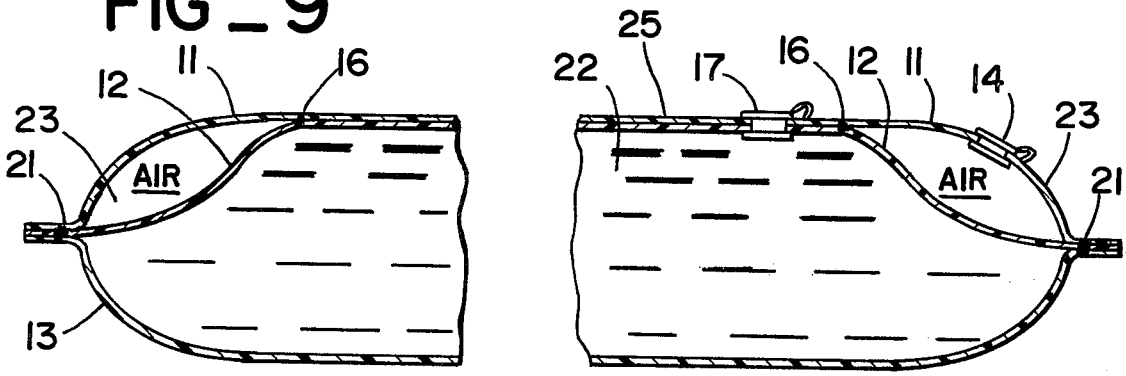
FIG. 10 is a cross-sectional elevation of the water mattress of the present invention.

The water mattress constructed according to the method of the present invention, shown in FIG. 10, includes a water chamber 22 and an air chamber 23. It should be noted that the water chamber 22 is defined by the web portions 12 and 13, and by the edge seam 21. The air chamber 23 is defined by the web portions 11 and 12, and the seams 16 and 21. The air chamber thus is disposed about the periphery of the water mattress 25, and may be inflated through valve 14. Access to the water chamber 22 is available through the water valve 17, which extends through both web portions 11 and 12. It should be noted that in the preferred embodiment, those parts of the web portions 11 and 12 which lie within the seam 16 are disposed in confronting, flush relationship, with no cavity or chamber defined therebetween. Thus, the portion of the water mattress within the seam 16, which supports most of the load on the water mattress and therefore receives most of the wear, is reinforced by virtue of the fact that it is supported by two thicknesses of polyvinyl material.

It is also a significant aspect of the present invention that the air chamber 23 provides substantial support for the edge portions of the mattress. That is, a load applied to the edge portion of the mattress will not cause the area supporting the load to sag or collapse. Rather, the air chamber will provide substantial support for the load, due to the rigidity caused by the air pressure therein, and also due to the buoyant support of the underlying water chamber 22. Thus, the water mattress of the present invention is capable of supporting an individual sitting on the edge of the mattress.

The preferred embodiment shown in the accompanying figures has been depicted as a rectangle having right angular corners. However, it may be appreciated that the method of the present invention may be employed to fabricate a water mattress having rounded corners, or non-linear edges. The construction of oval or round mattresses is also within the scope of the present invention.

It should be emphasized that the present invention provides an air chamber augmented water mattress which is fabricated from three identical sheets of material. The fabrication process requires only two welds, and two valves. Thus, the time required in cutting the pieces which form the water mattress, and the labor required to assemble the mattress, is reduced to a bare minimum. Thus, the water mattress of the present invention, which is superior in its edge support characteristics and its wave dampening properties, may be produced very inexpensively.

I claim:

1. A water mattress construction, comprising three web portions in vertically stacked relationship, said web portions being parallel and substantially identical in size and shape; a continuous edge weld joining the outer edges of said web portions in sealing fashion; a second, continuous weld spaced inwardly from said edge weld, joining the upper and medial ones of said web portions in sealing fashion; said mattress including a water chamber defined by said medial and the lower web portions and said edge weld; and an upper peripheral air chamber defined by said edge weld and said second weld, and by said upper end medial web portions, said air chamber being buoyantly supported by the portion of said water chamber disposed thereunder; a water valve disposed within the perimeter of said second weld, extending through said upper and medial web portions to said water chamber; and an air valve disposed between said edge weld and said second weld and extending through said upper web portion to said air chamber.

2. A method of constructing a water mattress, comprising the steps of providing three web portions of substantially similar size and shape, installing an air valve through a first of said web portions adjacent one end thereof, joining said first web portion to a second web portion in confronting relationship with a continuous, endless weld spaced inwardly from the edges of said web portions and said valve, installing a water valve through said first and second web portions, said water valve being disposed within the perimeter of said weld, and joining the third web portion to said first and second web portions, said third web portion being in confronting relationship with said second web portion, by a continuous, endless edge weld.

* * * * *